US010005606B2

(12) United States Patent
Esnault et al.

(10) Patent No.: US 10,005,606 B2
(45) **Date of Patent: *Jun. 26, 2018**

(54) PACKAGING SYSTEM FOR IMMOBILIZING OBJECTS IN A BOX HAVING A SQUARE OR RECTANGULAR CONFIGURATION

(71) Applicant: B+ EQUIPMENT, Aubagne (FR)

(72) Inventors: Christian Esnault, La Ciotat (FR); Claude Durand, Gemenos (FR)

(73) Assignee: B+ EQUIPMENT, Aubagne (FR)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/399,019

(22) Filed: Jan. 5, 2017

(65) Prior Publication Data

US 2017/0158405 A1 Jun. 8, 2017

Related U.S. Application Data

(63) Continuation of application No. 14/760,870, filed as application No. PCT/FR2014/050228 on Feb. 6, 2014, now Pat. No. 9,555,945.

(30) Foreign Application Priority Data

Feb. 12, 2013 (FR) ..... 13 51177

(51) Int. Cl.

| | |
|---|---|
| ***B65D 5/20*** | (2006.01) |
| ***B65D 81/05*** | (2006.01) |
| ***B65D 5/42*** | (2006.01) |
| ***B65D 5/50*** | (2006.01) |

(52) U.S. Cl.

CPC ..... *B65D 81/05* (2013.01); *B65D 5/4266* (2013.01); *B65D 5/5035* (2013.01)

(58) Field of Classification Search

CPC ..... B65D 5/50; B65D 5/20; B65D 5/4266; B65D 81/053

USPC ..... 206/592, 591; 229/930

See application file for complete search history.

(56) References Cited

U.S. PATENT DOCUMENTS 2,883,046 A 4/1959 Weiner
3,108,731 A 10/1963 Royce
3,927,823 A * 12/1975 Persson ..... B65D 5/2023 229/171

(Continued)

FOREIGN PATENT DOCUMENTS

DE 29615263 U1 10/1996
DE 20204975 U1 7/2003

(Continued)

*Primary Examiner* — King M Chu

(74) *Attorney, Agent, or Firm* — Egbert Law Offices, PLLC

(57) ABSTRACT

A packaging system for immobilizing one or more objects has a box having a bottom and at least four side walls and a wedge in the form of a sheet. The sheet has a central portion of a polygonal shape that is generally square or rectangular. The central portion has dimensions corresponding to the bottom of the box. The sheet has one or more flaps on each of at least two edges of the central portion. The flaps are attached by an articulation to the central portion so as to allow movement of the flaps to conform against the side walls of the box so as to fasten the wedge on the side walls of the box after the wedge has been pushed down into the box.

13 Claims, 5 Drawing Sheets

(56) References Cited

U.S. PATENT DOCUMENTS

| | | | | |
|---|---|---|---|---|
| 4,216,861 | A * | 8/1980 | Oliff | B65D 5/061 206/427 |
| 6,216,871 | B1 | 4/2001 | Bacques et al. | |
| 7,628,277 | B2 * | 12/2009 | Zietlow | B65D 5/5028 206/591 |

FOREIGN PATENT DOCUMENTS

| | | | |
|---|---|---|---|
| EP | 0251945 | A1 | 1/1988 |
| EP | 1197436 | A2 | 4/2002 |
| EP | 1452453 | A1 | 9/2004 |
| FR | 919469 | A | 3/1947 |
| FR | 1575635 | A | 7/1969 |
| FR | 2770447 | A1 | 5/1999 |
| FR | 2828169 | A1 | 2/2003 |
| GB | 977069 | A | 12/1964 |
| GB | 2620121 | A | 4/1993 |
| JP | 3017573 | U | 10/1995 |
| JP | H11268770 | A | 10/1999 |
| JP | 2001315761 | A | 11/2001 |
| JP | 4936843 | A | 4/2008 |

* cited by examiner

PACKAGING SYSTEM FOR IMMOBILIZING OBJECTS IN A BOX HAVING A SQUARE OR RECTANGULAR CONFIGURATION

CROSS-REFERENCE TO RELATED U.S. APPLICATIONS

The present application is a continuation of U.S. patent application Ser. No. 14/760,870, filed on Jul. 14, 2015, and entitled "Wedge for Immobilizing Objects in a Box Having a Square or Rectangular Cross-Section", which issued as U.S. Pat. No. 9,555,945 on Jan. 31, 2017.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a packaging system for immobilizing objects in a box. The present invention also relates to wedge elements for immobilizing the objects for the purposes of shipping and transportation of the objects. Furthermore, the present invention relates to packaging materials and wedge materials for such packaging. Furthermore, the present invention concerns a packaging system having a wedge element intended for being placed inside boxes used for the preparation and shipping of orders for single or multiple articles and more generally for boxes in which the content occupies a variable volume from one box to the next, and, most of the time, significantly less than the total volume of the box.

2. Description of Related Art Including Information Disclosed Under 37 CFR 1.97 and 37 CFR 1.98

It is known that boxes of this type are created by machines from one or several flanks of pliable rigid sheeted material and that their upper part features various flaps and turned-down pieces assembled by gluing or adhesive tape or a lid fitted over said upper part. A characteristic of these boxes is that they offer a constant volume once they have been produced and closed.

Several means are applied by the users or are integrated into the box forming or closing machines to fasten by wedges the objects which vary by number and unit volume from one box to another.

One is familiar, for example with wedging means constituted by heat-shrinking plastic film where one or several layers are secured to the bottom or the side walls of the box during its shaping. After the box has been filled, these films are lowered onto the pile of objects and then retracted by passing through a heating tunnel.

Such a process presents several disadvantages. As a matter of fact:

- this heat-shrink plastic film must necessarily be separated from the carton packaging prior to possible collection and recycling of the corresponding waste; this collection is a complex and very costly operation;
- this wedging material is itself expensive;
- its application is difficult and requires either complex automated machines or a great number of man-hours; the cost of these operations is therefore high.

Also known is the use of polystyrene particles or other light materials which are spread inside the box after insertion of the objects, in order to fill unused space.

Another fastening method consists of using inflatable plastic pockets which are placed inside the boxes to fill any unused space.

One is also familiar with the use of chips, particles, pelletized balls, . . . of paper, carton or wood which are put, in various forms, inside the boxes to fill unoccupied space between the objects.

Such production methods also present several disadvantages. As a matter of fact:

- the distribution dosage of these wedging materials so they fill exactly the unused space is an operation that is difficult to automate which requires either complex automated machines or a great number of man-hours; the cost of these operations is therefore high;
- collection of these materials after opening the packaging requires a number of different elements and is thus an operation not easily taken care of by the end user.

And one is also familiar with wedging elements presenting themselves in the form of a sheet of cardboard, corrugated or equivalent solid fiber featuring a central part which is put into contact with the upper surface of the pile of objects placed inside the box and flexible flaps on at least two sides of the central part of the sheet which are turned down and fastened, for instance by gluing, against the inside face of the side walls of said box.

Such wedging elements are, for example, described in the document EP-1 197 436. Documents FR-2 828 169, DE-2 02 04 975, EP-1 452 453, EP-0 251 945, U.S. Pat. No. 6,216,871, FR-1 575 635, FR-919 469, U.S. Pat. No. 3,108,731, U.S. Pat. No. 2,883,046, and FR-2 770 447 illustrate other implementations of wedging elements of this type or the technological background.

The implementation of the wedging element described in document EP-1 197 436 presents numerous advantages:

- This wedging element is not meant to fill up all the unused space inside the box; the quantity of material used is always the same and remains moderate, even when the previously packaged objects occupy only a very small portion of the volume of the box;
- This sheet can be made of a material similar to that used for producing the box itself, thereby greatly simplifying the recycling operations of the waste resulting from the elements constituting such a packaging.
- Placement and fastening of this sheet inside the box are mechanical operations which can be automated.

But the implementation of such a wedging element also presents some inconveniences.

As a matter of fact:

- the flat central part of the wedging sheet must be sufficiently sturdy and rigid to resist the constraints involved in the transportation of the box and maintain in a stable manner the products contained in it; under these conditions, it is often necessary to exert considerable efforts to deform it so that the largest portion of its surface will be in contact with the upper surface of the pile of objects; these efforts are inevitably transmitted to some of these objects and may damage them, if some of them are fragile;

when the lid of the box is removed, this wedging sheet constitutes an obstacle which prevents direct access to the packaged goods; for that this sheet needs to be torn away, but this operation is made difficult due to the absence of a grip area; to make this operation easier, it is known that the manufacturers usually put a plastic ribbon, called a pull strap, on the lower surface of box lids so as to facilitate opening of the lid by tearing the lid along the line created by this ribbon; the problem is that this pull strap can easily be put by the manufacturers only on the face of the lid on which grooves (also called channels) are made which mark the location of the folds of the flaps; on a lid, this face corresponds properly to the lower face; in the case of a wedging sheet as described, the face on which the grooves are made corresponds to the upper face of the wedge; it is thus not possible to easily place a pull strap on the bottom face of the wedge;

the material used for producing such a wedging sheet is most often corrugated board; this material, constituted in its so-called "single flute" version by 3 layers of paper (two flat sheets enclosing a corrugated sheet), poses a particular problem due to its anisotropic character: in effect, the folding of the various flaps along the grooves positioned perpendicularly to the flutes of the material does not pose a particular problem, whereas the folding of the flaps along the grooves positioned parallel to the flutes of the material has a tendency to deviate from the theoretical folding line created by the groove for the benefit of a most often polygon folding line, corresponding to the smallest effort needed to fold the flap taking into account the positions of the waves of the flute in the folding zone; the result of this deviation is an incorrect wedge geometry with dimensions between the turned-down flaps which may vary by significant proportions (in the order of the thickness of the wedging sheet, which is to say several millimeters);

the folding zone which connects the flaps to the central portion of the sheet is a zone of fragility; if special precautionary measures are not taken during the production of this wedge sheet, there exists a major risk of tearing of the material along this fold.

The problem at hand is therefore to provide a wedge in the form of a cardboard sheet, corrugated board or equivalent solid fiber material featuring a central portion which is put into contact with the upper surface of the pile of objects placed inside the box and flexible flaps, on at least two sides of the sheet, which are meant to be turned down and fastened, for example by gluing, to the internal face of the side walls of the box, this sheet:

must have a central portion that is sufficiently sturdy and rigid to resist the constraints during the transportation of the box and properly keep the product in these conditions, but must also be sufficiently pliable so that the largest portion of its surface can be put into contact with the upper surface of the pile of objects without exerting any major stress on these objects;

must allow a precise folding of the flaps along the theoretical folding line at their articulation with the central portion of the sheet, without making this articulation overly fragile.

The device described in document FR-2 828 169 does not allow to efficiently resolve the problem previously described. This device is constituted by a plate made of a semi-rigid material, such as cardboard or corrugated board, comprising a polygonal central portion with at least two parallel sides that are articulated by folding lines, strips or flaps the sides of which that are opposite the side walls of the container or box containing the items to be shipped are provided with an adhesive enabling them to become integral with said walls. It is pointed out, incidentally, that the central portion features folding lines parallel to two of its parallel sides which make it possible to deform said plate to apply it to portions of different heights of mixed lots of items to maintain in position in the boxes. According to the implementation illustrated in FIG. 3 of document FR-2 828 169, the polygonal central portion of the wedge plate features only two folding lines or grooves parallel to its short sides. Said central portion features, on the other hand, two weakening lines close together parallel to its large sides, however, these are not folding lines but perforating lines associated with a pull strap provided with a tab or "snake head" for traction.

Such a layout of the wedge sheet does not resolve the problem of efficient wedging of unusually shaped objects.

As a matter of fact, either the wedge sheet is made of material that is too rigid and, in this case:

it cannot mold very closely the uneven upper surface of the pile of objects;

it can exert significant pressure on said upper surface so that certain fragile objects may get crushed or damaged by this pressure.

or the wedge sheet is made of too soft material and risks being split open if the score lines yield under the pressure, leading to the tearing of said wedge sheet as it is being pushed into the box.

BRIEF SUMMARY OF THE INVENTION

The present invention is a packaging system for immobilizing one or more objects. The system includes a box having a bottom and at least four side walls, and a wedge comprising a sheet having a central portion of a polygonal shape in which the central portion has dimensions corresponding to the bottom of the box. The polygonal shape is either square or rectangular. The sheet has one or more flaps on each of at least two edges of the central portion. The flaps are attached by an articulation to the central portion so as to allow movement of the flaps to conform against the side walls of the box so as to fasten the wedge on the side walls of the box after the wedge has been pushed down into the box. The central portion has a plurality of grooves of curved or straight segments of folding lines within the central portion to facilitate a deformation of the wedge to conform to a shape of an upper surface. The plurality of grooves terminate at a periphery of the central portion. The plurality of grooves are not parallel with the edges of the central portion and are not parallel with each other.

The central portion defines front and rear opposing edges parallel to each other and defines left and right opposing edges perpendicular to the front and rear opposing edges. The front edge is adjacent to and between the left and right opposing edges. The rear edge is between and adjacent the left and right opposing edges. At least two edges of the central portion are adjacent in which each of the edges has one or more flaps attached to the central portion by articulations. Each groove of the plurality of grooves extends between the edges that are adjacent to the edges having the one or more flaps. Each of the articulations as a given length. Each groove of the plurality of grooves does not terminate within the given length of the articulation.

Each of the plurality of grooves has a first termination point and a second termination point at opposite ends of the groove. The first termination point is at an end of the articulations. The second termination point is at one of the front and rear opposing edges and the left and right opposing edges of the central portion outside the articulation.

The sheet further includes parallel flutes. At least some of the articulations are parallel to the flutes. The articulations that are parallel to the flutes comprise a plurality of scores. In one embodiment, at least some of the flutes are parallel to the other flutes. The articulations that are parallel to the flutes are preceded and succeeded by straight or curved segments at the periphery of the central portion and adjacent a respective articulation whereby folding of the flaps is facilitated along the respective articulation. In another embodiment, at least some of the articulations are not parallel to the flutes. The articulations that are not parallel to the flutes are preceded and followed by curved segments at the periphery of the central portion and adjacent a respective articulation.

The central portion has scores defining one or more tear tabs that are adapted to provide access through the central portion. The scores define a detachable portion adjacent the tear tabs that is configured to provide access to initiate tearing of the tear tabs. The sheet comprises a homogenous non-fluted material. The articulation is preceded and followed by curved segments at the periphery of the central portion and adjacent the respective articulation. At least two of the edges of the central portion have one or more flaps that are on opposite sides of the central portion. Each of the four edges of the central portion has one or more flaps attached to the central portion by articulations. Each of the front and rear opposing edges and the left and right opposing edges has one or more flaps attached to the central portion by articulations.

From these arrangements, the wedge can be made of a sturdy, rigid and resistant material, but it nevertheless can be deformed, without exerting a great effort. This occurs by folding the material around grooves that have been made on the central portion of the wedge. In an advantageous implementation, the central portion features also a score for starting a tear (constituted by a succession of curved or straight segments along with the material is perforated over all or part of its thickness) which the delimits a closed contour with a small surface.

The central portion also features other preparations spread out over the surface of the central portion beginning at the small closed contour of the score for starting a tear. These perforations defined tear tabs for obtaining, by simple traction, a large opening of the central portion of the wedge so as to give access to the articles within the box.

When the material that is used is corrugated board or any other material with a corrugated sheet, the articulations which are parallel to the flute, between the different flaps and the central portion, are characterized by the position of a groove, and, on at least a portion of the articulation, the perforation, without the perforations reaching the end of the articulations. As such, it is possible to proceed to the opening of the wedge by removing material located inside of the closed contour. This removal can be made by pushing the material in or by tearing it out. It is then possible to proceed to the removal of a large part of the central portion of the wedge by tearing up the material along the score lines which are spread out over the surface of the central portion. As such, it is possible to easily access objects that have been previously placed inside the box.

The flaps which are connected to the flute can be easily and precisely turned down along the perforations which have been made at the articulations, in the alignment of the periphery of the central portion. These articulations are not overly brittle to the extent that the end of the perforations is distanced from the end of the articulations. The articulations which are not perpendicular to the flute (or, if the material is homogenous, all the articulations) between the flaps and the central portion are not made brittle to the extent where the end of the articulations is not tangential to the periphery of the material.

In the present invention, the packaging system includes a wedge that perfectly immobilizes, in a stable manner, objects within the box, without exerting a high constraint on the objects and while producing an ecologically favorable packaging which can be easily recycled after use.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

BRIEF DESCRIPTION OF THE DRAWINGS

The advantages obtained by this invention will be better understood through the following description which refers to the attached drawings illustrating, without being in any way limiting, a particular implementation of a wedge according to the invention.

Reference to said drawings is made to describe an advantageous, although by no means limiting, example of production of a fastening wedge of the objects placed in a box, according to the invention.

DETAILED DESCRIPTION OF THE INVENTION

Figure 1:
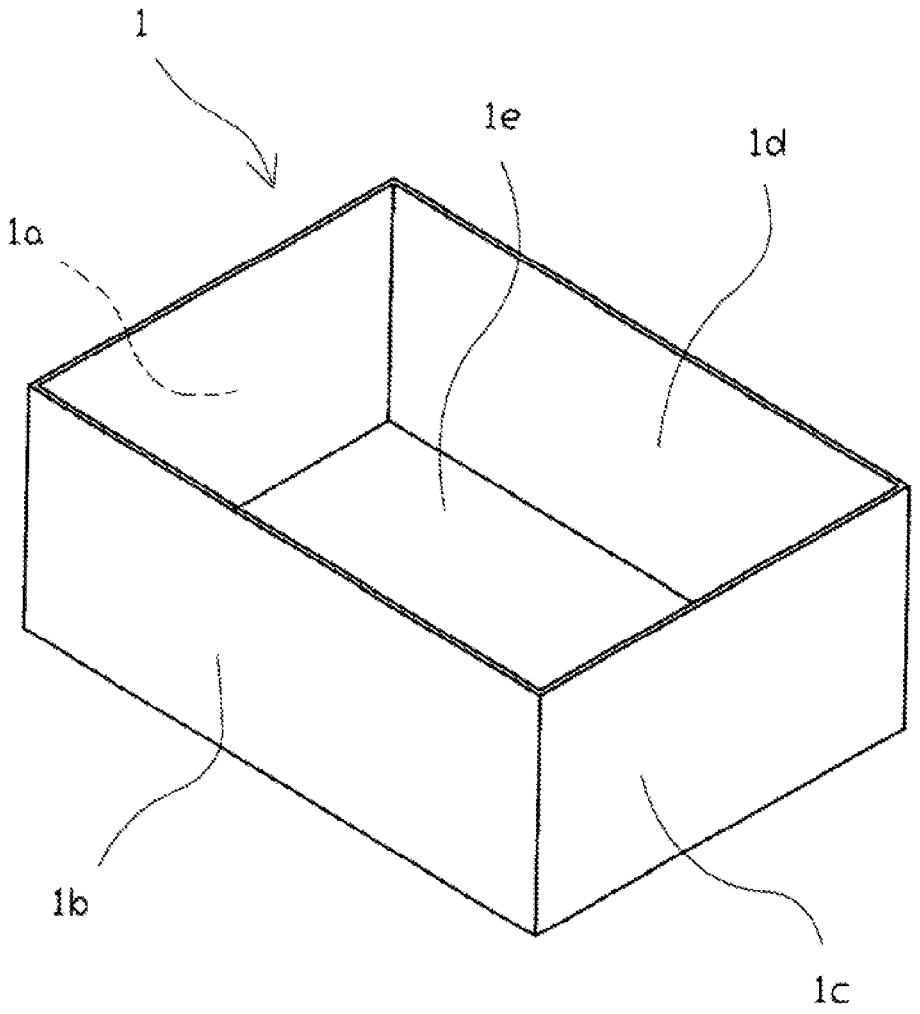
FIG. 1 is a perspective view of an empty box usable for wedging objects with a wedge according to the invention, shown without its lid.

FIG. 1 shows a type of box 1 which is composed of a bottom 1*e* and of four side walls 1*a*, 1*b*, 1*c*, and 1*d*, this type of box being in current use for shipping parcels containing various articles of different shapes which, when placed in the box, may present a very uneven upper surface.

According to the example shown, the bottom 1*e* has a rectangular shape so that the box provided with this bottom has the shape of a parallelepiped rectangle. It is shown that, according to this example, the side walls 1*a* and 1*c* are parallel to the width of the box 1 and that the side walls 1*b* and 1*d* are parallel to the length of the box 1.

It is emphasized that the bottom and the side walls could have a different shape, for example a square shape or a generally square or rectangular shape with cut angles.

This box 1 may be produced of solid fiber, corrugated board or any other equivalent sheeted material presenting the required qualities of rigidity and folding possibilities.

Figure 2:
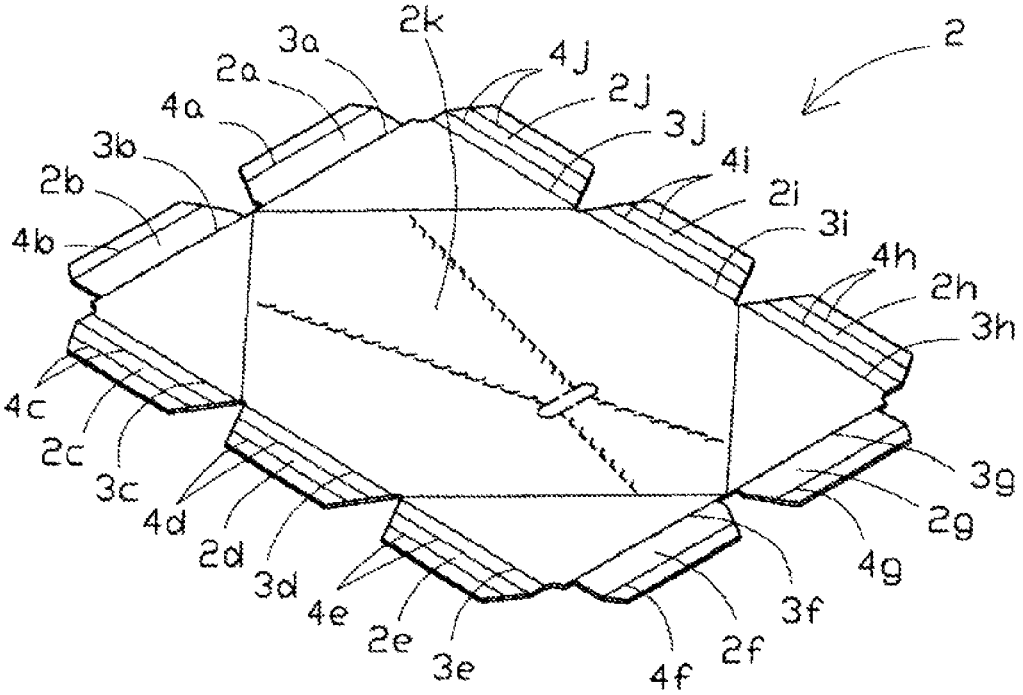
FIG. 2 is a perspective view of a wedging element according to the invention, before use.

FIG. 2 shows a wedge produced according to the invention. Said wedge 2 features a central portion 2*k* of shape and dimensions essentially equivalent to those of the bottom 1*e* of the box 1, so it can slide without any notable play between the side walls of said box when it is pushed into the latter. Said wedge 2 also features flexible flaps 2*a*, 2*b*, 2*c*, 2*d*, 2*e*, 2*f*, 2*g*, 2*h*, 2*i*, and 2*j*.

Said wedge 2 may be constituted by a rigid sheet made of rigid and deformable board, corrugated board or of any other equivalent sheeted material identical or not to that of which the boxes are made that are likely to receive such a wedging element.

Shown are the articulations of the flaps constituted by grooves or channels 3*a*, 3*b*, 3*c*, 3*d*, 3*e*, 3*f*, 3*g*, 3*h*, 3*i*, and 3*j* which connect said flaps to said central portion. Also shows are grooves 4*a*, 4*b*, 4*c*, 4*d*, 4*e*, 4*f*, 4*g*, 4*h*, 4*i*, and 4*j* that said flaps are equipped with, parallel to said articulations. It is known that said grooves 4*a*, 4*b*, 4*c*, 4*d*, 4*e*, 4*f*, 4*g*, 4*h*, 4*i*, and 4*j* constitute folding lines which allow reducing the surface of said flaps that is applied against the inside face of said four side walls for the benefit of the surface put into contact with said pile of objects when it is not plane and has therefore a surface larger than that of said central portion 2*k*.

Figure 3:
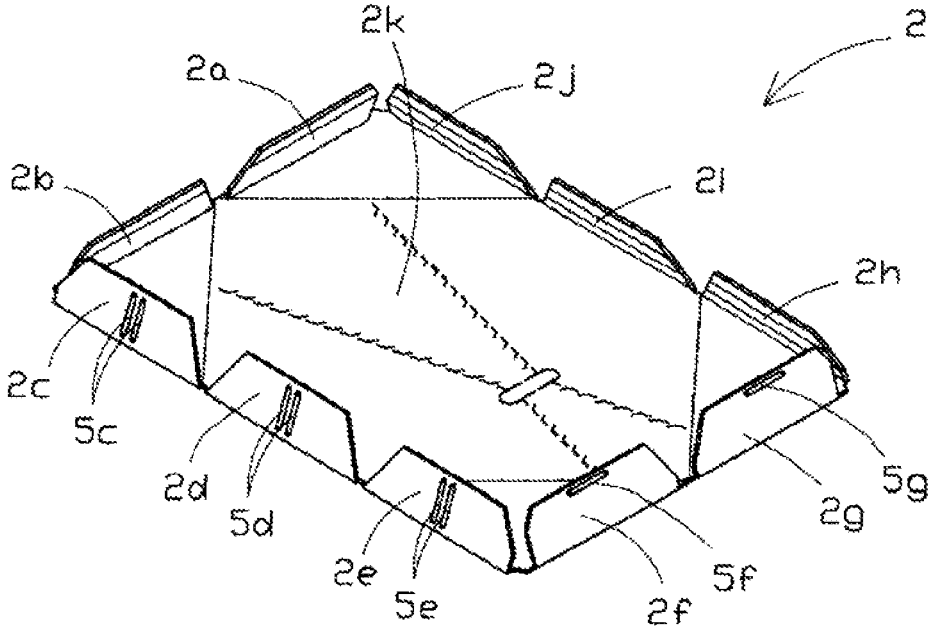
FIG. 3 is a perspective view of a wedge according to the invention, the flaps of which have been turned down before its insertion in the box to wedge objects.

FIG. 3 shows said wedge 2 made according to the invention, constituted by the central portion 2*k* and the flexible flaps 2*a*, 2*b*, 2*c*, 2*d*, 2*e*, 2*f*, 2*g*, 2*h*, 2*i*, and 2*j*. On this figure, said flaps have been turned upward around said articulations 3*a*, 3*b*, 3*c*, 3*d*, 3*e*, 3*f*, 3*g*, 3*h*, 3*i*, and 3*j*.

Shown are glue lines 5*c*, 5*d*, 5*e*, 5*f*, and 5*g*, deposited respectively of the outside face of said flaps 2*c*, 2*d*, 2*e*, 2*f*, and 2*g*, intended to be applied against the side walls of the box, when the wedge element has been pushed into the latter.

It is clear that glue lines or points (not shown) are also deposited on said flaps 2*a*, 2*b*, 2*h*, 2*i*, and 2*j*.

It is known that after insertion of said wedge 2 in the box 1, [after] putting said wedge in contact with said pile of objects positioned in said box, and deformation of said wedge 2 to optimally adapt to the shape of the upper face of said pile of objects, said flaps find themselves turned down and flattened against the inside face of the side walls 1*a*, 1*b*, 1*c*, and 1*d* of said box 1.

It is also known that there are means other than gluing to firmly attach said flaps to said side walls, such as stapling, fitting material parts into each other or any other means to obtain an equivalent result.

Figure 4:
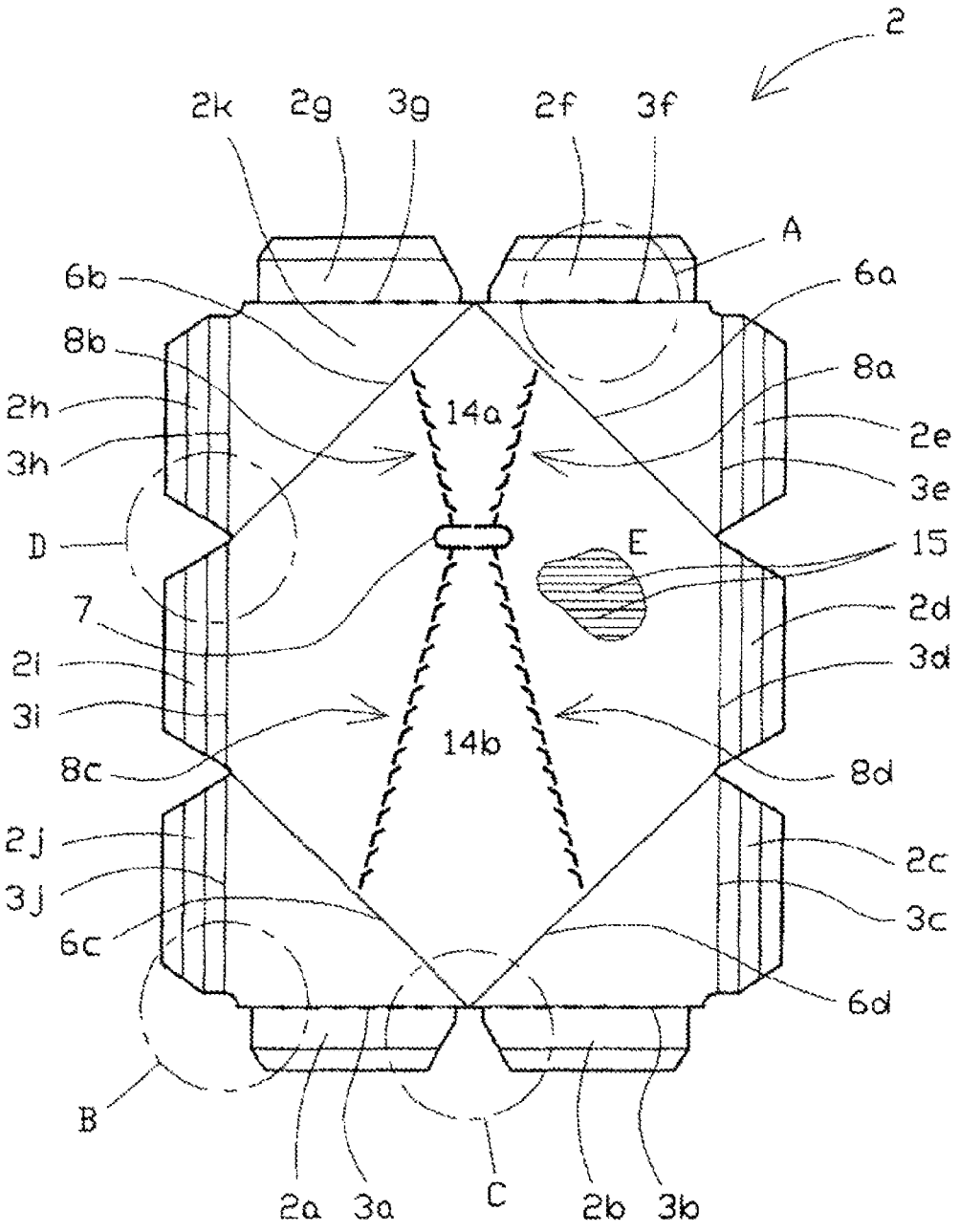
FIG. 4 is a plan view, with partial removal, of a wedge according to the invention.

FIG. 4 also shows said wedge 2 produced according to the invention, and shown in the flat, before folding and raising the peripheral flaps.

One sees the central portion 2*k* and the flexible flaps 2*a*, 2*b*, 2*c*, 2*d*, 2*e*, 2*f*, 2*g*, 2*li*, 2*i*, and 2*j* connected to said central portion 2*k* by means of the articulations 3*a*, 3*b*, 3*c*, 3*d*, 3*e*, 3*f*, 3*g*, 3*h*, 3*i*, and 3*j*.

According to a first characteristic arrangement of the invention, the central portion 2*k* of the sheet features a plurality of grooves 6*a*, 6*b*, 6*c*, 6*d* constituted by curved and straight segments along which the material the sheet is made of, is crushed and its thickness reduced. The two end or each groove 6*a*, 6*b*, 6*c*, 6*d* end at the periphery or in proximity of the periphery of said central portion 2*k* of said sheet; on the other hand, the two ends of this groove or of each groove end, preferably, at the end of the articulations 3*a*, 3*b*, 3*c*, 3*d*, 3*e*, 3*f*, 3*g*, 3*h*, 3*i*, and 3*j* between said flexible flaps and said central portion 2*k*, or outside of said articulations.

According to the invention, the grooves 6*a*, 6*b*, 6*c*, 6*d* are not parallel to each other, nor to the sides of the central portion 2*k* of the sheet 2 (in the case of a central portion of square shape), nor with the long sides of the central portion 2*k* of the plate 2, nor with the short sides of said central portion (in the case of a central portion of rectangular shape).

According to an advantageous arrangement, the two ends of each groove 6*a*, 6*b*, 6*c*, 6*d* end on two adjacent sides, respectively 3*j*-3*i*-3*h* 3*g*-3*f*; 3*g*-3*f* 3*e*-3*d*-3*c*; 3*e*-3*d*-3*c* 3*b*-3*a*; 3*b*-3*a* 3*j*-3*i*-3*h*, of the central portion 2*k* of the wedge 2.

The two ends of each groove 6*a*, 6*b*, 6*c*, 6*d* end at the ends of the articulations 3*a*, 3*b*, 3*c*, 3*d*, 3*e*, 3*f*, 3*g*, 3*h*, 3*i*, 3*j* between the flexible flaps and the central portion, or outside of said articulations.

Said groove 6*a* has one end essentially merged with one of the ends of said articulations 3*d* and 3*e* of said flaps 2*d* and 2*e* and its other end terminates between the ends of said articulations 3*f* and 3*g* of said flaps 2*f* and 2*g* and away from the ends of two successive articulations. Likewise, said groove 6*b* has one end which terminates between the ends of said articulations 3*f* and 3*g* of said flaps 2*f* and 2*g* and away from the ends of said successive articulations and its other end is essentially merged with one of the ends of said articulations 3*h* and 3*i* of said flaps 2*h* and 2*i*, said groove 6*c* has one end essentially merged with of the ends of said articulations 3*i* and 3*j* of said flaps 2*i* and 2*j* and away from the ends of said successive articulations and its other end terminates between the ends of said articulations 3*a* and 3*b* of said flaps 2*a* and 2*b*, and said groove 6*d* has one end which terminates between the ends of said articulations 3*a* and 3*b* of said flaps 2*a* and 2*b* and away from the ends of said successive articulations and its other end essentially merged with one of the ends of said articulations 3*c* and 3*d* of said flaps 2*c* and 2*d*.

It is understood that the grooves 6*a*, 6*b*, 6*c*, and 6*d* constitute folding lines for said central portion 2*k*, which facilitate the deformation of said wedge 2 which can assume a large variety of shapes in order to conform optimally to the shape of the upper surface of said pile of objects, in particular when said wedge is made of a sturdy and rigid material.

As indicated previously, the central portion 2*k* of the sheet could feature channels of diverse shapes adapted to specific articles to be expedited and shipped in the boxes.

One also sees, on FIG. 4, the score 7, in the form of a non-circular ring. This score 7 is constituted by a succession of straight or curved segments along which the material is scored over all or part of its thickness. Said score 7 delimits a closed contour of small surface. One understands that the portion of material included in this closed contour is attached to said central portion 2*k* but can easily be detached from said central portion 2*k* by pushing said material in or by tearing it out.

One also sees on FIG. 4 the score groups 8*a*, 8*b*, 8*c*, and 8*d*. One understands that, when the portion of material included in the closed contour delimited by said score 7 has been detached, it is possible to open said central portion 2*k*, by exerting traction beginning at the opening caused by tearing away the portion of material delimited by the score 7, so as to detach and lift the material tabs 14*a*, 14*b*, comprised between the pairs of score 8*a*, 8*b* and 8*c*, 8*d*, and thereby to open a large part of the central portion 2*k*, one now has easy access to the articles previously placed in the box.

One also sees, on FIG. 4, the zones A, B, C, and D. These zones of said wedge 2 are shown in greater detail on FIGS. 5, 6, 7, and 8, respectively.

Finally FIG. 4 shows zone E. In the particular presentation mode shown by FIG. 4, the material used for the creation of said wedge 2 consists of corrugated board or another material integrating an undulated sheet. Said zone E shows a "peel-away" view of said wedge 2 which reveals the flute of said material.

One sees that in the particular presentation mode of FIG. 4, the articulations 3*a*, 3*b*, 3*f*, and 3*g* are parallel to the flutes 15 of the corrugated board sheet, whereas the articulations 3*c*, 3*d*, 3*e*, 3*h*, 3*i*, and 3*j* are perpendicular to said flutes 15.

Figure 5:
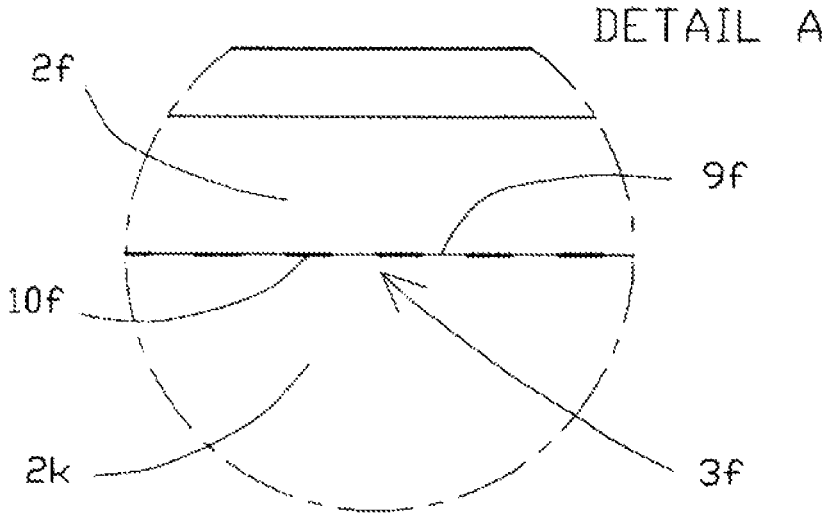
FIGS. 5, 6, 7, and 8 are detail and plan views of four different zones of a wedge according to the invention.

FIG. 5 shows in detail zone A of said wedge 2 produced according to the invention. This figure shows the central portion 2*k* and the flexible flap 2*f*. FIG. 5 also shows the articulation 3*f* which connects said flap 2*f* to said central portion 2*k*.

It is known that said articulation 3*f* is parallel to the flute of the material used for the creation of said wedge 2 when it is made of corrugated board, and FIG. 5 also shows that said articulation 3*f* is constituted by the superposition of a groove 9*f* and a score 10*f*, itself constituted by a succession of straight segments along which the material has been scored over all or part of its thickness.

One understands that the articulations 3*a*, 3*b*, and 3*g*, parallel to the flute of the material used for the creation of said wedge 2, are themselves constituted by the superposition of a groove and a score.

Figure 6:
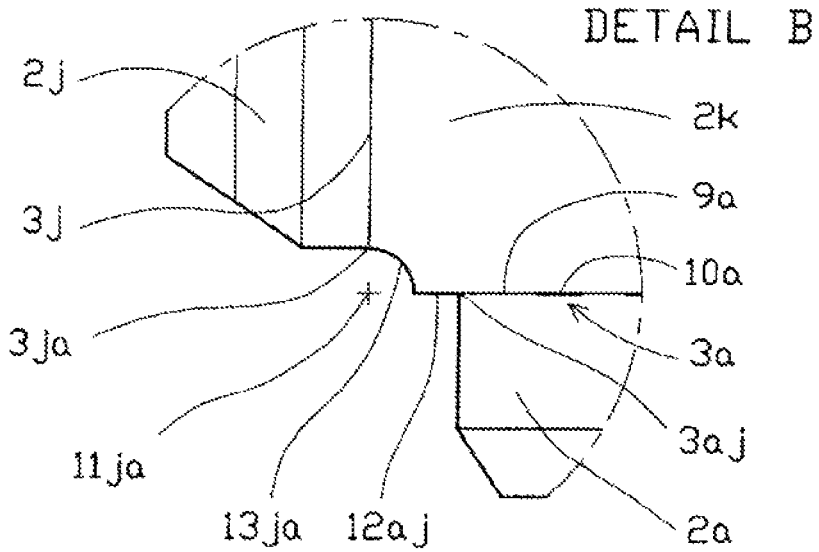

FIG. 6 shows in detail zone B of said wedge 2 created according to the invention. FIG. 6 shows the central portion 2*k* and the flexible flap 2*j*. FIG. 6 also shows the articulation 3*j* which connects said flap 2*j* to said central portion 2*k*. FIG. 6 also shows the flexible flap 2*a* and the articulation 3*a* which connects said flap 2*a* to said central portion 2*k*.

FIG. 6 also shows point 11*ja* which corresponds to one of the angles of the rectangle formed by said central portion 2*k* in the particular representation mode shown. One sees that said point 11*ja* is located at the intersection of the straight lines aligned on said articulations 3*j* and 3*a*. The same is true with respect to the angles of the rectangle located respectively at the intersection of the straight lines aligned on said articulations 3*b* and 3*c*, 3*e* and 3*f*, and 3*g* and 3*h*.

FIG. 6 also shows the point 3*ja* which corresponds to one of the two ends of articulation 3*j*. Then again, one knows that said articulation 3*j* is perpendicular to the flute of the material used for the creation of said wedge 2.

FIG. 6 also shows the curved segment 13*ja* which belongs to the periphery of said central portion 2*k*. The characteristic of said segment 13*ja* is that it is tangential to the periphery of said flexible flap 2*j* at point 3*ja*. One realizes that thanks to this characteristic said articulation 3*j* is prevented from becoming brittle by the creation of a starting point of a fracture at point 3*ja*. One understands that other curved segments similar to segment 13*ja* are likewise tangents to the periphery of said flexible flaps 2*c*, 2*e*, and 2*h*.

FIG. 6 also shows that said articulation 3*a* is constituted by the superposition of a groove 9*a* and a score 10*a*.

FIG. 6 also shows the point 3*aj* which corresponds to one of the two ends of the articulation 3*a*.

It should also be remembered that according to one implementation said articulation 3*a* is parallel to the flute of the material used for the production of said wedge 2.

FIG. 6 also shows the straight segment 12*aj* which belongs to the periphery of said central portion 2*k*. A characteristic of said segment 12*aj* is that it is tangential to said articulation 3*a* at the point 3*aj*. It is clear that this characteristic facilitates the folding of said flap 2*a* along said groove 9*a* and said score 10*a* beginning at point 3*aj*.

It is clear that other straight segments similar to segment 12*aj* are, likewise, tangential to said articulations 3*b*, 3*f*, and 3*g*.

Figure 7:
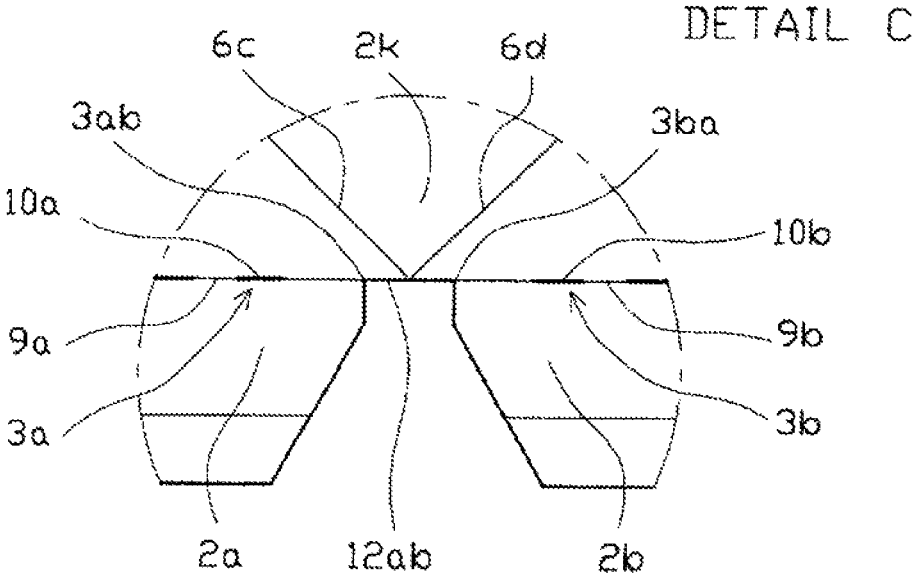

FIG. 7 shows in detail the zone C of said wedge 2 produced according to another implementation of the invention. This figure shows the central portion 2*k* and the flexible flap 2*a*. FIG. 7 also shows the articulation 3*a* constituted by the superposition of the groove 9*a* and the score 10*a* which connects said flap 2*a* to said central portion 2*k*. FIG. 7 also shows the flexible flap 2*b* and the articulation 3*b* constituted by the superposition of the groove 9*b* and the score 10*b* which connects said flap 2*b* to said central portion 2*k*.

It should also be remembered that said articulations 3*a* and 3*b* are parallel to the flute of the material used for the production of said wedge 2.

FIG. 7 also shows the grooves 6*c* and 6*d* made on said central portion 2*k* and it can be seen that the ends of said grooves 6*c* and 6*d* are located in the same zone as the end 3*ab* of the articulation 3*b* and as the end 3*ba* of the articulation 3*b*, but outside of said articulations.

FIG. 7 also shows the straight segment 12*ab* which belongs to the periphery of said central portion 2*k*. The characteristic of said segment 12*ab* is that it is tangential to said articulation 3*b*, at point 3*ab*, and to be also tangential to said articulation 3*b*, at point 3*ba*. It is clear that this characteristic facilitates the folding of said flap 2*a* along said groove 9*a* and said score 10*a*, beginning at point 3*ab* as well as folding of said flap 2*b* along said groove 9*b* and said score 10*b*, beginning at point 3*ba*.

It is clear that another straight segment similar to segment 12*ab* is, likewise, tangential to articulations 3*f* and 3*g*.

Figure 8:
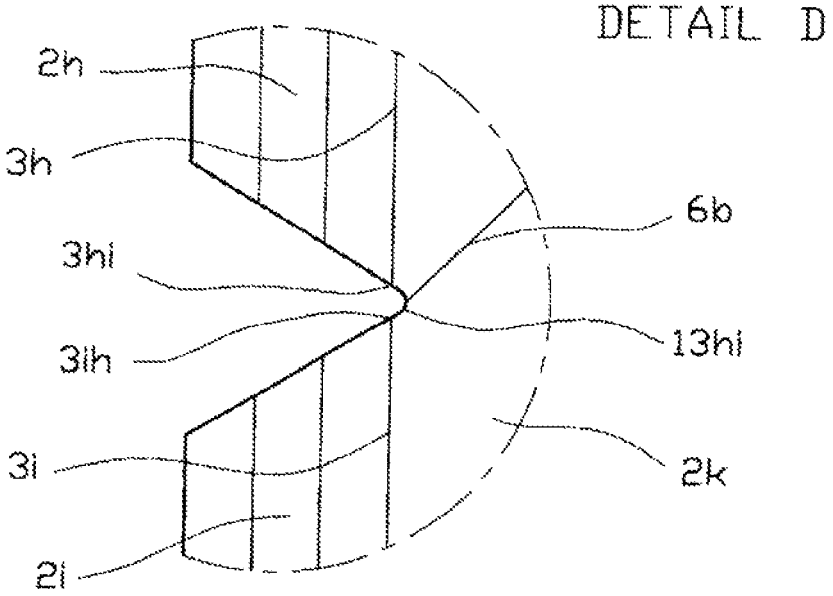

FIG. 8 shows, in detail, the zone D of said wedge 2 produced according to another example of implementation of the invention. This figure shows the central portion 2*k* and the flexible flap 2*h*. FIG. 8 also shows the articulation 3*h* which connects said flap 2*h* to said central portion 2*k*. FIG. 8 also shows the flexible flap 2*i* and the articulation 3*i* which connects said flap 2*i* to said central portion 2*k*.

It should also be remembered that said articulations 3*h* and 3*i* are perpendicular to the flute of the material used for the production of said wedge 2.

FIG. 8 also shows the groove 6*b* made on said central portion 2*k* and it shows that the end of said groove 6*b* is situated in the same zone as the end 3*hi* of the articulation 3*h* and as the end 3*ih* of the articulation 3*i*, but outside of said articulations.

FIG. 8 also shows the curved segment 13 *hi* which belongs to the periphery of said central portion 2*k*. It is characteristic of said segment 13*hi* to be tangential to the periphery of said flexible flap 2*h* at point 3*ih*. One realizes that thanks to this characteristic said articulations 3*h* and 3*i* are prevented from becoming brittle by the creation of a starting point of a fracture at points 3*hi* and 3*ih*.

It is clear that other curved segments similar to segment 13 *hi* are, likewise, tangential to the periphery of said flexible flaps 2*i* and 2*j*, 2*c* and 2*d*, and 2*d* and 2*e*.

We claim:

1. A packaging system for immobilizing one or more objects, the packaging system comprising:

a box having a bottom and at least four side walls, wherein the one or more objects that are placed in said box form an upper surface opposite to the bottom of said box; and a wedge comprising a sheet having a central portion of a polygonal shape that is generally square or rectangular, said central portion having dimensions corresponding to said bottom of said box, said sheet having one or more flaps on each of at least two edges of said central portion, the one or more flaps attached by an articulation to said central portion so as to allow movement of the one or more flaps to conform against the side walls close that box so as to fasten said wedge on the side walls of said box after said wedge has been pushed down into said box, said central portion having a plurality of grooves of curved or straight segments of folding lines within said central portion to facilitate a deformation of said wedge to conform to a shape of an upper surface, said plurality of grooves terminating at a periphery of said central portion, said plurality of grooves not parallel with edges of said central portion and not all parallel with each other.

2. The packaging system of claim 1, wherein said central portion defines front and rear opposing edges parallel to each other and defines left and right opposing edges perpendicular to the front and rear opposing edges, the front edge being adjacent to and between the left and right opposing edges, the rear edge being between and adjacent the left and right opposing edges, each of at least two edges of said central portion that are adjacent has the one or more flaps attached to said central portion by articulations, each group of said plurality of grooves extending between said at least two edges.

3. The packaging system of claim 2, wherein each of the articulations has a given length and wherein each groove of said plurality of grooves does not terminate within the given length of the articulation.

4. The packaging system of claim 3, wherein each of said plurality of grooves has a first termination point and a second termination point at opposite ends of the groove, the first termination point being at an end of the articulations, the second termination point being at one of the front and rear opposing edges and the left and right opposing edges of said central portion outside the articulation.

5. The packaging system of claim 1, said sheet further comprising parallel flutes, at least some of the articulations being parallel to said flutes, the articulations that are parallel to said flutes comprising a plurality of scores.

6. The packaging system of claim 1, said sheet comprising parallel flutes, said articulations that are parallel to said flutes being preceded and succeeded by straight or curved segments at the periphery of said central portion and adjacent a respective articulation whereby a folding of the one or more flaps is facilitated along the respective articulation.

7. The packaging system of claim 1, said sheet comprising parallel flutes, at least some of the articulations are not parallel to said flutes, the articulations that are not parallel to said flutes are preceded and followed by a curved segment at the periphery of said central portion and adjacent a respective articulation.

8. The packaging system of claim 1, wherein said central portion has scores defining one or more tear tabs that are adapted to provide access through said central portion.

9. The packaging system of claim 8, said scores defining a detachable portion adjacent the one or more tear tabs that is configured to provide access to initiate tearing of the one or more tear tabs.

10. The packaging system of claim 1, said sheet comprising a homogenous non-fluted material, the articulation being preceded and followed by curved segments at the periphery of said central portion and adjacent a respective articulation.

11. The packaging system of claim 1, wherein at least two of the edges of said central portion having one or more flaps that are on opposite sides of said central portion.

12. The packaging system of claim 1, wherein said central portion defines four edges comprising front and rear opposing edges parallel to each other and defines left and right opposing edges perpendicular to the front and rear opposing edges, wherein each of the four edges of said central portion has one or more flaps attached to said central portion by articulations.

13. The packaging system of claim 2, wherein each of said front and rear opposing edges and said left and right opposing edges has one or more flaps attached to said central portion by articulations.

* * * * *